United States Patent [19]

Baldensperger et al.

[11] Patent Number: 4,465,129

[45] Date of Patent: Aug. 14, 1984

[54] HEAT EXCHANGER CORE ASSEMBLY CONSTRUCTION AND METHODS OF MAKING THE SAME

[75] Inventors: Gary L. Baldensperger, Warren, Pa.; John D. Real, Jamestown, N.Y.

[73] Assignee: Blackstone Corporation, Jamestown, N.Y.

[21] Appl. No.: 369,990

[22] Filed: Apr. 19, 1982

[51] Int. Cl.[3] ..... F28F 9/16

[52] U.S. Cl. ..... 165/153; 165/173; 285/137 R; 285/158

[58] Field of Search ..... 165/153, 178, 173, 175; 29/157.4; 285/137 R, 158

[56] References Cited

U.S. PATENT DOCUMENTS

| | | | |
|---|---|---|---|
| 1,744,932 | 1/1930 | Swank | 165/173 X |
| 2,349,792 | 5/1944 | Rosenblad | 165/173 |
| 2,368,391 | 1/1945 | Young | 165/178 X |
| 2,398,788 | 4/1946 | Hedrick | 285/158 |
| 2,447,259 | 8/1948 | Lucke | 285/158 |
| 2,488,627 | 11/1949 | Hisey | 165/151 |
| 3,245,465 | 4/1966 | Young | 165/173 X |
| 3,338,600 | 8/1967 | Wahl | 285/158 |
| 3,583,478 | 6/1971 | Fieni | 165/178 |

FOREIGN PATENT DOCUMENTS

| | | | |
|---|---|---|---|
| 2009122 | 9/1970 | Fed. Rep. of Germany | 165/178 |
| 608433 | 7/1926 | France | 165/178 |
| 394129 | 6/1933 | United Kingdom | 165/178 |
| 1232414 | 5/1971 | United Kingdom | 165/153 |

*Primary Examiner*—Sheldon J. Richter

*Attorney, Agent, or Firm*—Buell, Blenko, Ziesenheim & Beck

[57] ABSTRACT

A heat exchanger core and header of the fin and tube type is provided having a plurality of tubes disposed in generally axially parallel and spaced apart relation, a fin assembly between adjacent tubes, a header plate at one end of said tubes, said header plate having a series of openings therein adapted to receive said tubes and generally uniformly spaced from the sidewalls of said tube ends, an elongate ferrule in each said opening substantially filling the area between said openings and said tubes and extending axially along said tubes from said header at least on the side opposite the fins and a metallurgical bond between the ferrule and tubes and between the ferrules and header.

6 Claims, 8 Drawing Figures

HEAT EXCHANGER CORE ASSEMBLY CONSTRUCTION AND METHODS OF MAKING THE SAME

This invention relates to heat exchanger core assembly construction and methods of making the same and particularly to heat exchanger core units for heat exchangers used in the cooling systems of internal combustion engines used in motor vehicles and particularly heavy duty vehicles such as trucks, tractors, construction equipment, diesel locomotives, off road vehicles and the like.

In the case of heavy duty vehicles, particularly, the tube to header plate connections are subject to extreme strains which result from vibrations, thermal cycle shocks and stresses, and various mechanical stress and strains. Of particular significance are thermal stress, which are the result of the exchanger being subjected to different temperatures or rapidly changing temperatures. In a heat exchanger, such as a truck, it is possible to deliver water at a temperature approaching the boiling point into a radiator assembly whose temperature is at a sub zero level when a thermostat opens on a cold sub zero winter morning. Even when the liquid circulating in the system is at equilibrium, the air fins will be subject to the ambient sub zero temperature. As a result of this thermal shock and thermal differential, the various parts of the radiator assembly will expand and contract at unequal rates creating tremendous stresses. As a result of these stresses, heavy duty vehicles in particular have historically had a very high rate of radiator failure at the junction of the header plate and tubes. There have been a variety of proposals made to solve this problem with some slight success, but the problem has continued to plague the industry for years. One proposal, set out in U.S. Pat. No. 3,245,465 by Young was to form openings with extruded edges into which the tube ends passed and were soldered. This resulted in some slight improvement in the life of radiators made in accordance with that teaching. Another proposal was that set out in U.S. Pat. No. 2,932,489 also by Young, to provide a truss arrangement on the core frame to restrict the movement of the header and core. Another proposal by Modine, in U.S. Pat. No. 1,767,605 was to use U-shaped strengthening members between the upper and lower header plates to resist deformation. More recently, radiators have been strengthened by applying gusset plates at the opposite ends of the header plates with some small improvement in life. However, none of the prior art proposals has provided a really satisfactory solution to the problem and the life extension made by them has been in the range of 10% or less.

The present invention which provides a new heat exchanger core assembly construction overcomes these deficiencies of prior art radiator constructions and provides a core and header assembly which will withstand thermal cycling and the stresses to which radiators are subject to provide a comparable life more than 30 times longer than conventional prior art structures.

This invention provides a heat exchanger core and header of the fin and tube type comprising a plurality of tubes disposed in generally axially and spaced apart relation, a fin assembly between adjacent tubes, a pair of header plates having a series of openings therein generally uniformly spaced from the sidewalls of said tube ends, an elongate ferrule in each said openings and said tubes and extending axially along said tubes from said header on each side thereof and a metallurgical bond between the ferrules and tubes and between the ferrules and headers. Preferably the openings in the header plates are upset above one face of the header plate providing a rounded surface around each opening on one side of the header plate, and an upstanding flange around the opening on the opposite side of the header plate and a flanged elongate ferrule is inserted in each opening having a radially outwardly curved flange at one end bearing on and matching the rounded surface of the opening and extending through and substantially above the upstanding flange on the opposite side of the header plate. The ferrules may be brazed into the openings in the header plates and the tubes soldered into the ferrules by dipping in a solder bath in conventional manner. Preferably the ferrules are formed with a radial curved flange in contact with a curved opening and flange of the header plate and soldered at the same time as the tube is soldered in the ferrule in a single dip operation. Preferably the ferrule is of heavier construction than the tube used in the radiator and it may be swaged into the rounded opening to form the flange on one end corresponding to the rounded opening or it may be preformed and inserted.

In the foregoing general description of this invention, certain objects, purposes and advantages of the invention have been set out. Other objects, purposes and advantages of this invention will be apparent from a consideration of the following description and the accompanying drawings in which.

Figure 1:
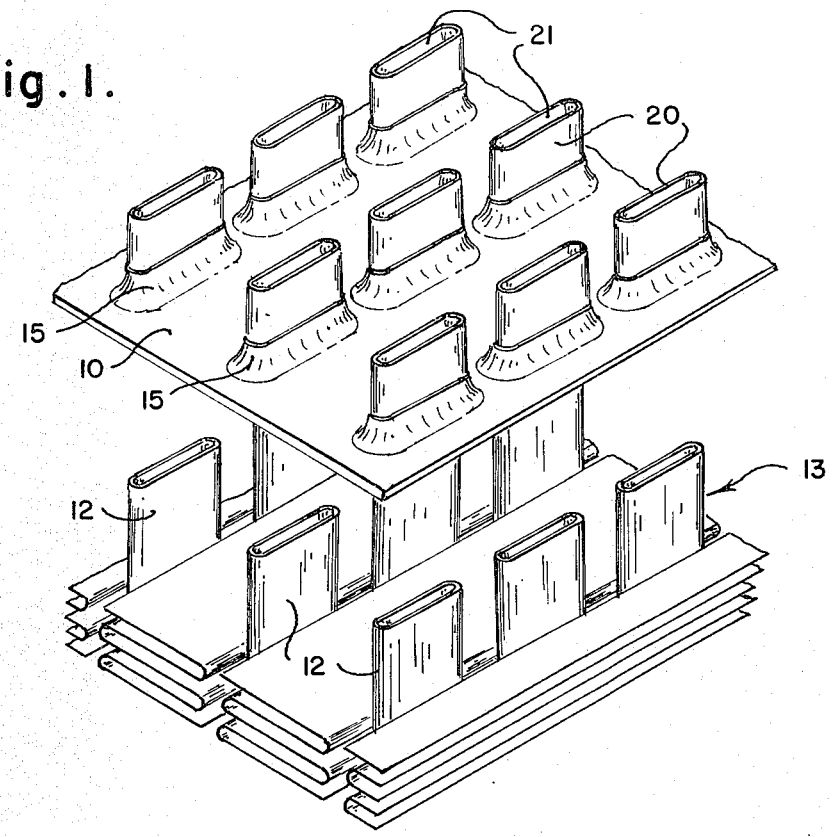
FIG. 1 is an exploded isometric view of a portion of a header plate and of a finned tube assembly preparatory to their being assembled, the ferrules being shown in place on the header plate.
Figure 2:
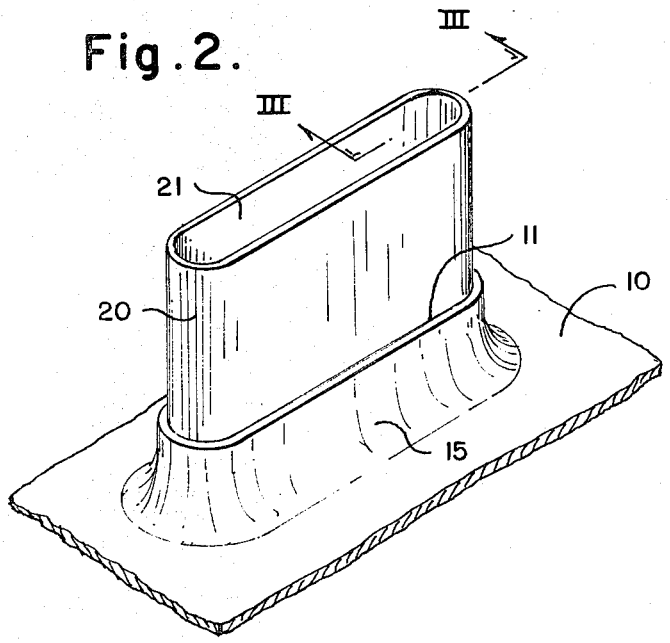
FIG. 2 is an enlarged fragmentary isometric view of a portion of header plate of FIG. 1 with a ferrule attached.
Figure 3:
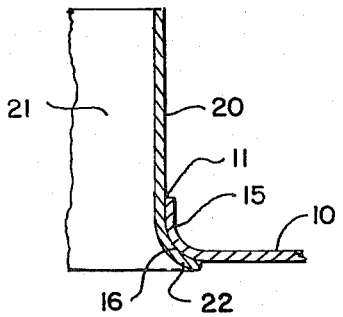
FIG. 3 is a section on the line III—III of FIG. 2.
Figure 4:
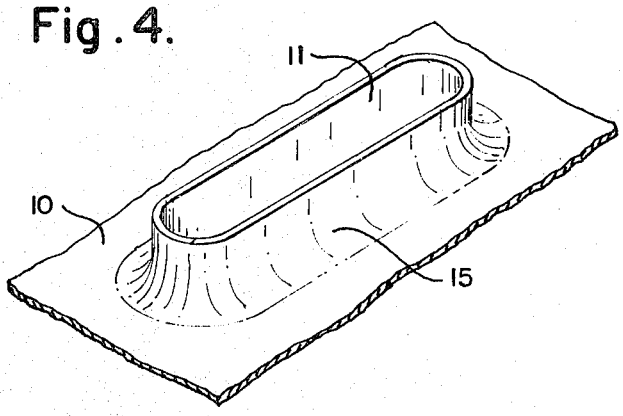
FIG. 4 is an enlarged fragmentary isometric view of a portion of header plate without the ferrule inserted.
Figure 5:
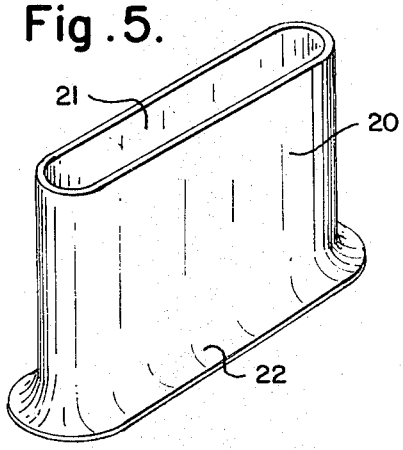
FIG. 5 is an isometric view of a ferrule for insertion into a tube opening of the header plate of FIG. 4.
Figure 6:
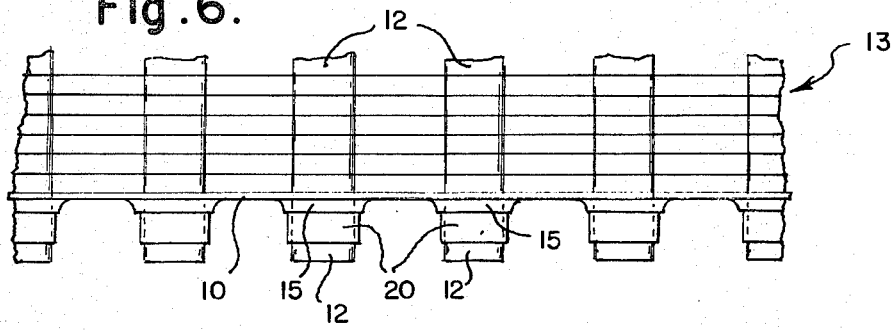
FIG. 6 is an end view of a core assembly of FIG. 1 in completed condition.

Referring to the drawings there is illustrated in FIGS. 1 through 6, a presently preferred embodiment of this invention in which a header plate 10 of copper or brass has generally parallel rows of elongate openings 11 formed therein for reception of tubes 12 of the finned tube assembly 13. The tubes 12 may be either extruded or seamed but are preferably of elongate shape with opposite walls parallel and opposite lateral ends rounded. Generally the tubes are formed of a copper alloy.

The openings 11 of header plate 10 are preferably formed so as to provide upset flanges or rims 15 extending above and transverse to one side of the header plate 10 and with a rounded surface 16 on the opposite side. An elongate ferrule 20 which fits snugly into the opening 11 within flanges 15 is inserted in each opening to extend substantially above the top of flange 15. Each ferrule 20 has an inner passage 21 adapted to snugly and slidably receive a tube end 12. Preferably one end of ferrule 20 is swaged or upset to provide an outwardly curved radial flange 22 at one end which matches the curved or rounded surface 16 of opening 11 in the header plate.

The radiator core assembly is assembled with the tube ends 12 passing through ferrules 20 from the swaged end 22 so as to extend out of the opposite end. The ferrules 20 are held in openings 11 of header plate 10 and extend outwardly away from rims 15. The assembly of tubes, ferrules and header plate is dipped into a molten solder bath sufficiently to permit solder to enter the passage 21 surrounding tube 12 and to enter between rim 15 and ferrule 20 and by capillary action enter the area between the swaged end 22 of the ferrule and rounded entrance to opening 11 of the header plate.

Alternatively the ferrules 20 could be first placed in openings 11 and brazed in place after which the tubes 12 are assembled in openings 21 of the ferrules and dipped in solder to bond the tubes in the ferrules. Either of these metallurgical bonding techniques is acceptable.

Figure 7:
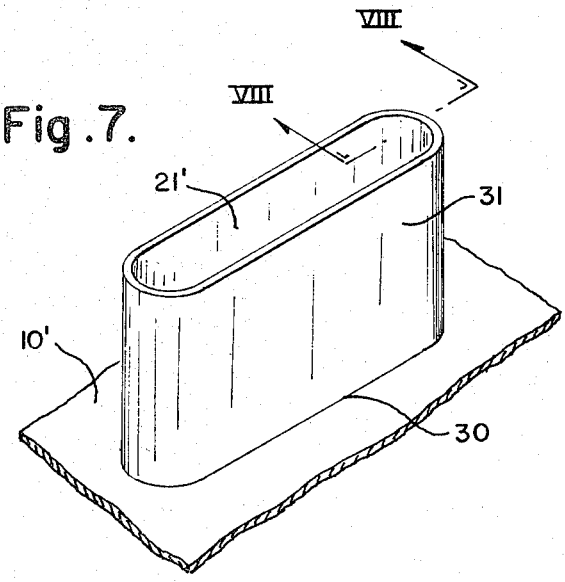
FIG. 7 is an enlarged fragmentary isometric view of a portion of header plate with a ferrule inserted according to a second embodiment of this invention.
Figure 8:
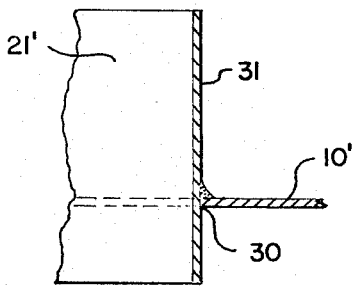
FIG. 8 is a section of the line VIII—VIII of FIG. 7.

In FIGS. 7 and 8, there is illustrated another embodiment of this invention in which like parts bear like identifying numerals with a prime sign. In this embodiment, the header plate 10' is provided with elongate openings 30 into which elongate ferrules 31 slidably and snugly fit with a portion extending beyond each surface of the header plate. Each of these openings 30 may have an upset rim 15' and rounded entry 16' as in FIGS. 1 through 6 or it may be a clean punched opening. The ferrule is provided with an axial opening or passage 21' adapted to snugly and slidably receive a tube end 12. The ferrules and header plate are assembled with the ferrules extending uniformly on opposite sides of the header plate as shown in FIG. 8 and preferably brazed in position after which the tubes 12 are inserted and dipped in solder to bond them in the ferrules. However, the ferrules, tubes and header plate may be all assembled and solder dipped to form the core assembly. Experience has indicated, however, that this latter practice is much less satisfactory than brazing the ferrules in place.

Core assemblies made according to this invention have been compared with conventional core assemblies such as those of U.S. Pat. No. 3,245,465 and have given more than 30 times the number of extreme thermal cycles before failing.

In the foregoing specification certain preferred practices and embodiments of this invention have been set out, however, it will be understood that this invention may be otherwise embodied within the scope of the following claims.

We claim:

1. A heat exchanger core and header of the fin and tube type characterized by improved resistance to stress failure between tubes and header comprising a plurality of tubes disposed in generally axially parallel and spaced apart relation, a fin assembly between adjacent tubes, a header plate at one end of said tubes, said header plate having a series of openings therein adapted to receive said tubes and generally uniformly spaced from the sidewalls of said tube ends, said openings in the header being upset to form a flange extending away from the fin assembly on one side of the header plate and a curved entry into the opening on the other side of the header plate facing the fin assembly, an elongate ferrule in each said opening substantially filling the area between said openings and said tubes and extending axially along said tubes from said header on the side opposite the fins, said ferrule being provided at one end facing the fin assembly with a generally curved radial flange generally matching and overlaying the curved entry to the openings in the header plate, a metallurgical bond between the ferrules and tubes and between the ferrules and header over substantially their entire contacting areas.

2. A heat exchanger assembly as claimed in claim 1 wherein the ferrule is metallurgically bonded to the header plate with a braze alloy and the tube is metallurgically bonded to the ferrule with soft solder.

3. A heat exchanger assembly as claimed in claim 1 wherein the metallurgical bond is a soft solder bond.

4. A heat exchanger assembly as claimed in claim 1 or 2 or 3 wherein the wall thickness of the ferrule is intermediate the wall thickness of the header plate and tube.

5. A heat exchanger assembly as claimed in claims 1 or 2 or 3 wherein the wall thickness of the ferrule is at least as thick as the thickness of the header plate.

6. A heat exchanger assembly as claimed in claims 1 or 2 or 3 wherein the wall thickness of the ferrule is no greater than the thickness of the tube wall.

* * * * *